US006149726A

United States Patent [19]

Ueberschär

[11] Patent Number: 6,149,726

[45] Date of Patent: Nov. 21, 2000

[54] FLOATING DOCTORING APPARATUS

[75] Inventor: Manfred Ueberschär, Dettingen, Germany

[73] Assignee: Voith Sulzer Papiermaschinen GmbH, Heidenheim, Germany

[21] Appl. No.: 09/145,365

[22] Filed: Sep. 1, 1998

[30] Foreign Application Priority Data

Sep. 2, 1997 [DE] Germany ..... 197 38 356

[51] Int. Cl.[7] ..... B05C 11/04

[52] U.S. Cl. ..... 118/110; 118/118; 118/123; 118/126; 118/262; 118/414

[58] Field of Search ..... 118/110, 118, 118/123, 126, 261, 262, 413, 414; 427/359; 162/281; 101/120; 15/256.5

[56] References Cited

U.S. PATENT DOCUMENTS

| | | | |
|---|---|---|---|
| 3,683,851 | 8/1972 | Nolden | 118/126 |
| 3,701,335 | 10/1972 | Barnscheidt | 118/104 |
| 3,795,188 | 3/1974 | Giani | 101/120 |
| 4,757,782 | 7/1988 | Pallinen | 118/411 |
| 4,907,528 | 3/1990 | Sollinger | 118/121 |
| 5,483,885 | 1/1996 | Leineweber | 101/169 |
| 5,529,806 | 6/1996 | Eriksson | 427/356 |

FOREIGN PATENT DOCUMENTS

| | | |
|---|---|---|
| 36 20 374 A1 | 2/1987 | Germany . |
| 41 20 486 A1 | 12/1992 | Germany . |
| 43 41 351 C1 | 3/1995 | Germany . |
| 43 34 553 A1 | 4/1995 | Germany . |
| 196 04 934 A1 | 1/1997 | Germany . |

OTHER PUBLICATIONS

"New Development in the Area of Coating Equipment for Paper and Carton: Control of Coating Cross Profile" by Dr. Ing. H. P. Sollinger, reprint from "Wochenblatt für Papierfabrikation" No. 23/24 (1989), pp. 1072–1076.

*Primary Examiner*—Laura Edwards
*Attorney, Agent, or Firm*—Taylor & Aust, P.C.

[57] ABSTRACT

A device for doctoring and/or metering a liquid or viscous medium on a moving operating surface includes a doctoring assembly having a doctoring surface extending transversely across the entire operating surface and pressing thereagainst. A doctoring support beam movably supports the doctoring assembly in a direction transverse to the operating surface. A pressure unit produces a force which is exerted on the doctoring assembly in order to produce a contact pressure between the doctoring surface and the operating surface. Undesired temperature-based movements of the doctoring support beam relative to the operating surface can be compensated for by a compensation device located in the pressure flow path between the doctoring support beam and the doctoring assembly. This ensures that the contact pressure between the doctoring surface and the operating surface is substantially unaffected by such movements or deformations of the doctoring support beam. Thus, a compensation system for targeted counter-deformation of the doctoring support beam is not necessary.

14 Claims, 3 Drawing Sheets

FLOATING DOCTORING APPARATUS

BACKGROUND OF THE INVENTION

1. Field of the Invention

The present invention relates to a device to scrape and/or meter a liquid or viscous medium on a moving operating surface.

2. Description of the Related Art

During operation of such a device, undesired deformations of a doctoring support beam often occur relative to the operating surface. In the paper industry, the main reason for these deformations is the uneven heating of the doctoring support beam, wherein that side of the doctoring support beam facing the operating surface receives more heat from the comparatively warmer medium, such as coating ink or glue, than does the side of the doctoring support beam facing away from the operating surface. A temperature gradient occurs in the doctoring support beam which leads to a deflection of the metering rod support. A deformation occurs in which the doctoring support beam deflects in the center toward the operating surface but remains at its edges a relatively greater distance from the operating surface. The result is an uneven cross profile of the medium remaining on the operating surface. In other words, there is an uneven coating thickness of applied medium across the width of the working surface.

Particularly on relatively large operating surface widths with correspondingly wide doctoring support beams, i.e. supports of 8 to 10 meters or wider, a trough-shaped coating profile occurs if no special compensation devices are provided. This phenomenon is discussed in an article "New development in the area of coating equipment for paper and carton: Control of coating cross profile" by Dr. Ing. H. P. Sollinger—reprint from "Wochenblatt fur Papierfabrikation" No. 23/24 (1989), Pages 1072–1076. From this article, methods of compensating for the deflection of the doctoring support beam are also known. As a result of the methods, the achieved coating cross profile is less trough-shaped and more uniform. Under the method of a pneumatic contact pressure system for the doctoring component, a pneumatically activated contact pressure tubing is held on the doctoring support beam and presses the doctoring component against the operating surface. The flexible contact pressure tubing is equipped to partially compensate for unevenness, particularly such unevenness as is found in the deflection of the doctoring support beam. In practical terms, however, it has been found that such pneumatic flexible tubing provides an insufficient averaging of the coating profile. Particularly because of the material-related non-homogeneity and the comparatively rough manufacturing tolerances of the pneumatic flexible tubing, new irregularities with relatively large peak deviations are created. Also, the trough-shaped characteristics of the cross profile cannot be completely compensated for.

A method for additional compensation is described in the aforementioned article in which deformations of the doctoring support beam are intentionally caused. The deformations are intended to counteract the undesired doctoring support beam deflections.

In a thermal system, separate water circuits can be used to produce different temperatures on the front and back sides of the doctoring support beam. By suitable targeted adjustment of water circuit temperatures, a desired deformation of the doctoring support beam can be effected to the point that a straight doctoring support beam is achieved.

In a mechanical system, several flexible pressure tubes are provided in a doctoring support beam. The pressure tubes may effect the targeted deformation of the doctoring support beam by suitable pressure application. Both the thermal and the mechanical systems permit total compensation of operationally dependent, undesirable deformations of the doctoring support beam, and lead to an almost perfectly uniform coating cross profile. However, a disadvantage of this compensation system which directly affects the doctoring support beam is the high cost of the component parts of the compensation system, as well as the high cost of its control. First of all, the linear deviations of the doctoring support beam must be measured. This is usually done by laser measurement, which is very cost intensive. These laser measurement results must then be converted into control signals, which will control the temperatures in the water circuits and the pressure in the flexible pressure tubing. Complicated control algorithms are necessary for comparison purposes. Finally, the component part: expenditure for the control circuit, including the water circuits and the flexible pressure tubing, is considerable.

The current invention provides a low cost method of compensating for undesirable deformations in the doctoring support beam and of achieving a substantially uniform coating cross profile in an above-described type of doctoring device.

SUMMARY OF THE INVENTION

To solve these problems, the present invention provides compensation device, a part of which is located in the power flow path between the doctoring support beam and the doctoring component. The compensation device is designed to compensate for the deformations of the doctoring support beam relative to the operating surface. Thus, the contact pressure force between the doctoring surface and the operating surface is substantially unaffected by these deformations.

The current invention turns away from the principle that is predominant in the current state of the art, that is, to compensate for undesirable deformations in the doctoring support beam by targeted counter-deformation. The present invention takes advantage of the knowledge that a constant contact pressure between the doctoring surface and the operating surface is essential for a uniform coating cross-profile, as well as for a uniform longitudinal coating profile. The longitudinal coating profile is the profile of the coating thickness in the longitudinal direction, or in the flow direction of the operating surface. The method of the current invention provides that the compensation unit that is provided exclusively in the power flow path between the doctoring support beam and the doctoring component does not target a dimensional constancy of the doctoring support beam, but instead provides a force constancy between the doctoring surface and the operating surface. Thus, the substantially undesirable deformations of the doctoring support beam can be compensated for by the method of the current invention. Also, a complicated and expensive compensation system to keep the doctoring support beam straight can be dispensed with. In particular, the expensive laser sensory analysis which is necessary under the current state of the art for distance measurements between the doctoring support beam and the operating surface, as suggested in the aforementioned article by Dr. Ing. H. P. Sollinger, can be dispensed with.

According to the method of the present invention, optimum operational conditions with regard to the effective contact pressure are always present between the doctoring surface and the operating surface. Not only the substantially undesirable deformation of the doctoring support beam can be compensated for in this manner, but also the uneven wear and tear of the doctoring components and the unevenness in the operating surface. Without the negative influence of such disturbing influences, a constant contact pressure between the doctoring surface and the operating surface is always achieved.

The present invention includes:

a doctoring element having a doctoring surface extending transversely across the entire operating surface, wherein the doctoring surface can be pressed against the operating surface;

a doctoring support beam which flexibly supports the doctoring components in a direction transverse to the operating surface;

a power unit for exerting a pressure force onto the doctoring components in order to produce contact pressure between the doctoring surface and operating surface; and a compensation device to compensate for undesired deformations of the doctoring support beam relative to the operating surface which occur during operation, whereby at least one component of the compensation device is located in the flow path of the pressure that is exerted by the power unit, between the doctoring support beam and the doctoring component.

In a preferred further advancement of the current invention, the compensation device located in the power flow path between the doctoring support beam and the doctoring components includes at least a fluidal, pneumatic compensation device. This compensation device may include a power unit for exerting pressure force onto the doctoring components, thereby providing an effective pressure area that is activated by a pressure medium. The effective pressure area size is substantially independent from the deformations of the doctoring support beam relative to the doctoring component. A pressure medium supply arrangement is provided which is designed to regulate and maintain a constant pressure upon the effective pressure area. The substantially constant size of the effective pressure area and the constancy of the pressure affecting the effective pressure area ensures that the force supplied to the doctoring component, and thereby the effective contact pressure force between the doctoring surface and the operating surface, always remains substantially constant. Deformations of the doctoring support beam then does not affect the contact pressure force between the doctoring surface and the operating surface.

The power unit can include a piston-cylinder arrangement with a cylinder housing and a piston arrangement with at least one piston moving in a cavity in the cylinder housing. A pressure chamber that is connected to a pressure medium supply is provided in the cavity, the capacity of which is governed by the cylinder housing and the piston arrangement. Such a piston-cylinder arrangement represents a simple design of a compensation device having an approximately dimensionally constant pressure effective area.

The piston may run in a sliding seal in the cylinder housing, whereby the piston directly borders the pressure chamber. With its side facing toward the pressure chamber, the piston forms the effecting pressure area. Because of the low frictional losses, however, a solution is preferred in which the power unit includes a compensation diaphragm which is held around its edge to the cylinder housing. The compensation diaphragm forms a pressure-medium-tight division in the pressure chamber cavity, and, with its side facing the pressure chamber, forms the area affected by the pressure. At least one piston is then in contact with the side of the diaphragm facing away from the pressure chamber, allowing pressure force to be transferred. The diaphragm method is preferable insofar as the diaphragm ensures hermetic sealing of the pressure chamber. The diaphragm is also maintenance free and no lubrication is necessary. Furthermore, the stick-slip effect that is associated with the piston and the slide seal can be avoided. Finally, the diaphragm method distinguishes itself through low wear and tear and long life span.

Effectively, the cylinder housing is provided at the metering rod support, whereby at least the one piston is coupled with the doctoring component for the purpose of common shifting movement. Since the doctoring component wears out relatively quickly and accordingly must be replaced comparatively frequently, it is advisable to produce the piston as a separate entity from the doctoring component with which it is coupled mechanically. The piston is in pressure contact with the doctoring component and can be disengaged from the doctoring component. Thus, the doctoring component can be replaced without having to replace the piston at the same time.

An especially smooth and low loss compensation device results when the pressure transferring piston is substantially unguided at the cylinder housing, but is in position-stabilizing and positive contact with the doctoring component.

Any frictional losses that may occur between the piston and the cylinder housing due to mechanical frictional contact can thereby be avoided.

The pressure chamber can extend continuously along the entire width of the operating surface, wherein the diaphragm is designed as an elongated strip diaphragm which is subjected to the pressure in the pressure chamber along the entire width of the operating surface. Several pistons distributed along the width of the operating surface move independently from each other and are in contact with the diaphragm. The pressure in the pressure chamber is identical at all points. Therefore, the same pressure is exerted on the diaphragm at each point of the pressure chamber. Thus, a constant contact pressure between the doctoring surface and the operating surface is produced across the entire width of the operating surface. A targeted cross profiling of the coating thickness of the applied medium, which could be achieved by a targeted local change of the contract pressure between the doctoring surface and the operating surface, is not possible by pressure variations in the pressure chamber. Longitudinal profiling is, of course, possible. The pressure:Ln the pressure chamber is varied based upon the measured coating thickness of a previously coated section of the operating surface.

Another preferred method of the invention provides that several pressure chambers equipped with one specifically circular compensation diaphragm are provided along the width of the operating surface. At least one piston is in contact with each of the compensation diaphragms. If a predetermined pressure is independently adjustable in all of the pressure chambers, then a cross profiling of the coating thickness of the medium is also possible.

Within the scope of the present invention, the doctoring component can also be a flexible doctor blade or a doctor strip. However, a design is preferred in which the doctoring component includes a metering rod bed with a pivoted or rotating metering rod. The support includes an elongated supporting beam on which the metering rod bed is held, specifically by use of a leaf spring arrangement.

The method according to the invention is preferred as a part of a device for the application of a liquid or viscous medium onto a moving material web, specifically a paper or cardboard web. The application device may be designed for direct or indirect application of medium onto the material web. During direct application, the medium is applied directly onto the material web. For example, it may be sprayed on. In indirect application, the medium is first applied onto an applicator roll, from which it is transferred to the material web. The method according to the invention is suitable for both types of application devices. It may be utilized in final metering whereby the coating thickness of previously applied and premetered medium is subjected to a final fine-metering. It may, however, also be used in the immediate area of the medium application location, whereby the doctoring component actually functions as the applicator element and conducts a rough metering of the applied medium. Furthermore, the device of the invention may also be used for cleaning of the applicator roll, in order to scrape ink residues and dirt particles from the applicator roll.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
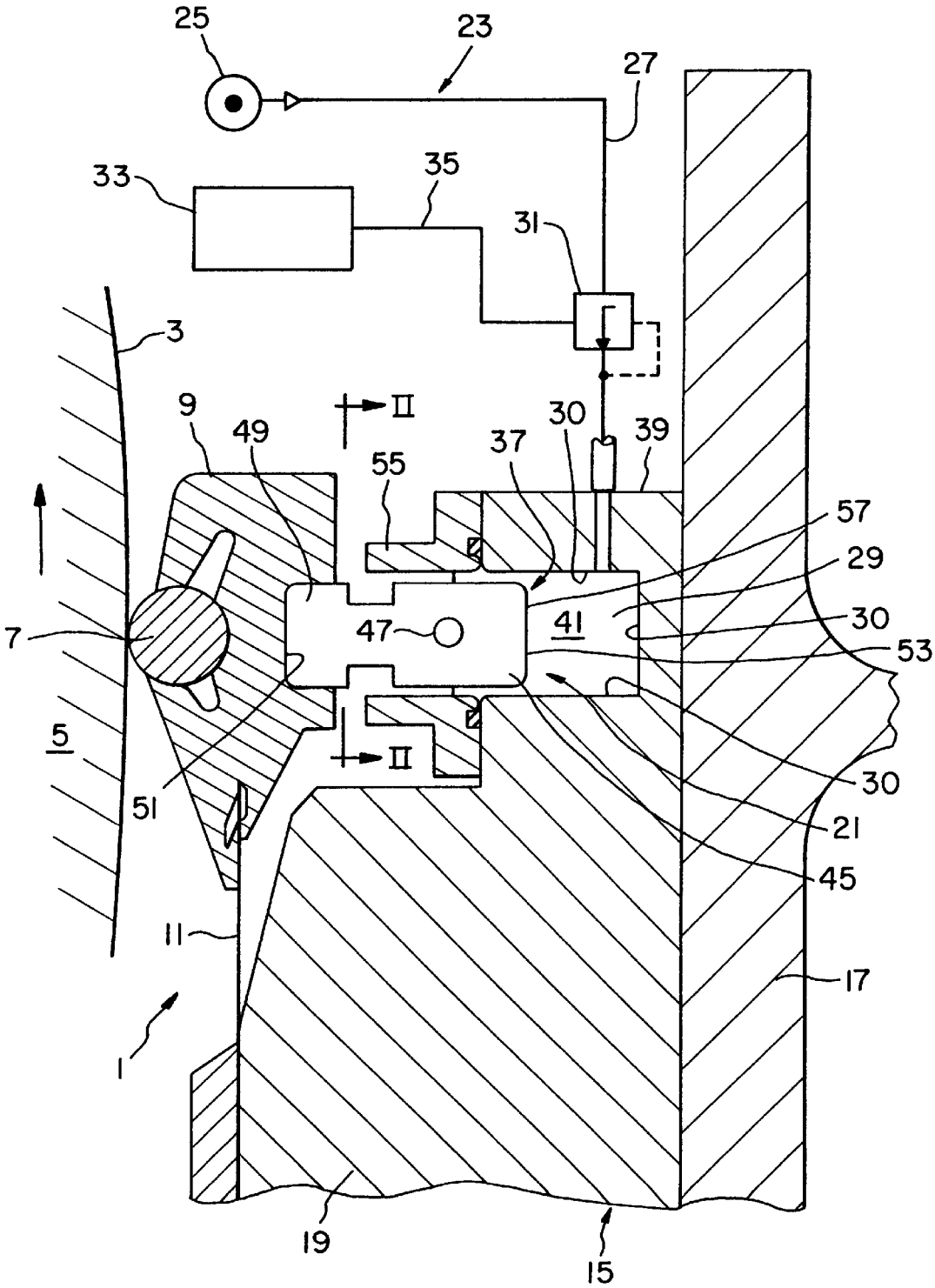
FIG. 1 is a partially schematic, side, sectional view of an embodiment of a floating doctoring apparatus of the present invention.

Referring now to the drawings and particularly to FIG. 1, there is shown a doctoring and/or metering unit 1. It is a part of an applicator device for the application of a uniform layer of a liquid or viscous coating medium onto an operating surface 3 running past the doctoring and/or metering device 1. In the illustrated example in FIG. 1, the operating surface 3 is formed by the circumferential surface of an applicator roll 5, which serves to indirectly apply the coating medium to a non-illustrated material web, which may be paper, cardboard or carton. The coating medium may also be applied directly to such a material web, whereby the material web would then run over a support or backing roller.

The doctoring and/or metering device 1 includes a revolving doctor in the form of a metering rod which is pivoted in a metering rod bed. The metering rod 7 with its shell surface forms a doctoring surface with which it is pressed against operating surface 3. The metering rod bed 9 is of a substantially conventional design and, therefore, will not be discussed in detail. The metering rod bed 9 is clamped to a doctoring support beam, generally identified with 15, with the use of a leaf spring 11. The flexibility of leaf spring 11 enables the position of the metering rod 7 to be variable in a direction substantially orthogonal to the operating surface 3. When changing the metering rod 7 and/or the metering rod bed 9, the metering rod bed 9 can be removed together with leaf spring The doctoring support beam 15 includes an elongated doctor support bar 17. The leaf spring 11 is held on this doctor support bar 17 by use of a clamp holder 19. The doctor bar 17 is subject to operational deformations, which are mainly caused by temperature differences between its side facing the operating surface 3 and its side facing away from the operating surface 3. These temperature differences occur because during coating operations in a paper or cardboard production line, the applied coating medium is relatively warm. Therefore, the side of the doctor support bar 17 facing toward the operating surface 3 is subjected to the heat radiating from the coating medium and warms up to a greater degree than the backside of the doctor support bar 17. The result is that the doctor support bar 17 deflects at its longitudinal center toward the operating surface 3. This causes localized distance fluctuations between doctor support bar 17 and operating surface 3. In order to compensate for these distance fluctuations, a compensation device 21 is provided between the doctor support bar 17 and the metering rod bed 9. Compensation device 21 ensures constant contact pressure between the metering rod 7 and the operating surface 3 regardless of any such distance fluctuations. It has been found that, for a uniform coating thickness of the applied medium, a constant contact pressure between metering rod 7 and the operating surface 3 is essential. In order to produce the contact pressure force between the metering rod 7 and the operating surface 3, the compensation device 21 is arranged in the flow path of a force produced by a pressure producing unit 23. The force is exerted against the metering rod bed 9. The flow path of this force runs between the doctoring support bar 17 and the metering rod bed 9. This means that in order to press the metering rod bed 9 and the metering rod 7 against the operating surface 3, the doctoring support bar 17 must absorb the exerted pressures.

The force producing device 23 includes a pneumatic pressure source 25 which is connected, through a pneumatic line 27, with a pressure chamber 29. Pressure chamber 29 is defined by a set of inner walls 30 in doctoring support beam 15, The pneumatic line 27 is equipped with a pressure regulator valve 31 which compensates for possible pressure fluctuations in the pneumatic pressure source 25 and ensures constant pneumatic pressure in pressure chamber 29.

The pneumatic pressure delivered by the pressure regulator valve 31 on the output side may be established through a control device 33, for example a microprocessor. For this purpose, the pressure regulator 31 takes the form of a controllable pressure regulating valve which is connected via a control line 35 with the control unit 33. Triggering of the pressure regulator 31 through the control line 35 may, for example, be pneumatic or electric.

Figure 2:
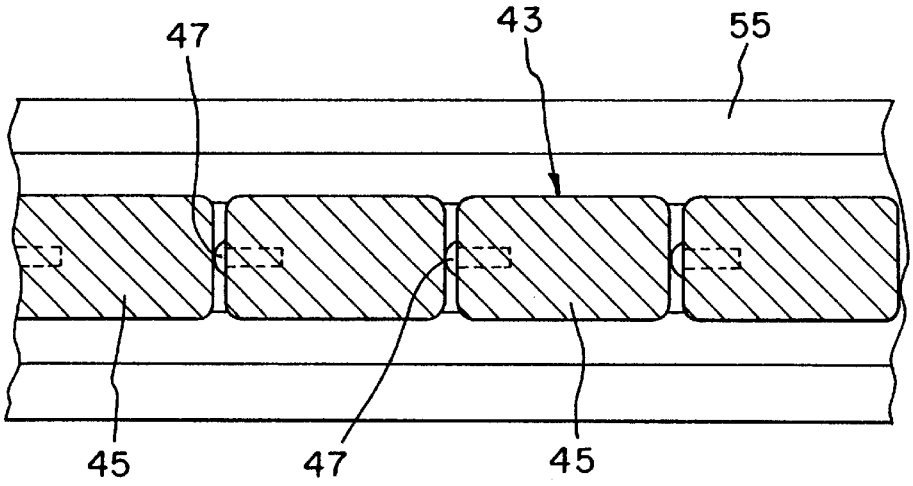
FIG. 2 is a fragmentary, sectional view of the piston arrangement of FIG. 1 taken along line II—II.

The compensation device 21 includes a piston-cylinder arrangement 37. This includes a cylinder housing 39 which is rigidly connected to the doctoring support bar 17. Cylinder housing 39 has a cavity 41 which borders the pressure chamber 29. FIG. 2 shows that a piston arrangement 43 of the piston-cylinder arrangement 37 includes several pistons 45 which are arranged end to end along the width of the operating surface 3 (that is, vertically to the plane of projection of FIG. 1), and which are separated from each other by spacers 47. The spacers 47 are the round heads of screws, each of which are screwed into one of the pistons 45. The spacers 47 ensure an independent movability of the pistons 45 which are arranged as individual components, so that the pistons 45 do not interfere with each other in their individual movement. A multitude of pistons 45 are arranged across the width of operating surface 3. The length of a piston 45 in the direction of the width of the operating surface 3 may be only a few centimeters so that a compensation unit 21 can react favorably to local distance fluctuations between the doctoring support bar 17 and the operating surface 3.

Each of the pistons 45 is movable in the cavity 41 in a direction substantially orthogonal to the operating surface 3. With a piston head 49 protruding from the cavity 41, the pistons 45 engage positively in a centering retainer 51 which is adapted to the head contours of the piston heads 49 and which is located in the metering rod bed 9. The pistons 45 are pressed into this centering seat 51 by the pressure in the pressure chamber 29. The positive engagement between the piston head 49 and the centering retainer 51 causes the pistons 45 to be pressed against the metering rod bed 9 substantially without wobble. Thus, guiding of the piston 45 inside the cavity 41 is no longer necessary. For this reason, the pistons 45 maintain a distance at their circumference from the inside wall of the cylinder housing 39 that is bordering the cavity 41. Friction losses between the pistons 45 and the cylinder housing 39 are therefore avoided.

The pressure chamber 29 is bordered by a compensation diaphragm 53. The compensation diaphragm 53 is held around its edge on the cylinder housing 39 whereby its edge can be clamped or positively held between the cylinder housing 39 and a screw on a housing cap 55. The compensation diaphragm 53, which divides the pressure chamber 29 in the cavity 41, is arranged as an elongated elastic tape strip diaphragm extending across the entire width of the operating surface 3. The pressure chamber 29, therefore, extends continuously across the entire width of the operating surface 3. The diaphragm 53 is put over the end of the piston 45 that faces toward pressure chamber 29 such that diaphragm 53 makes surface contact with the side of each piston 45. An area 57 of diaphragm 53 that is subject to the effects of the pressure in pressure chamber 29 is determined by the outside contours of piston 45. In order to enable diaphragm 53 to press against piston 45, it is constructed from an elastomer material.

A pneumatic pressure is built up in pressure chamber 29 by the power generating device 23. This pneumatic pressure, which is held constant by the pressure regulator 31, causes a force to be exerted onto diaphragm 53 and pistons 45 whereby the metering rod bed 9 and metering rod 7 are pressed against operating surface 3. The compensation device 21 with the piston-cylinder arrangement 37 may also be seen as part of the force generating device 23 in the design example shown in FIG. 1. Enlargement or reduction of the pressure chamber 29 results from changes in the distance between the doctoring support bar 17 and the operating surface 3. The effective size of the pressure influencing area 57 for introducing force into the metering rod bed 9, however, remains unchanged. The effective size of the pressure influencing area 57 substantially corresponds to the cross-sectional area of piston 45. Along with the constantly held pressure in pressure chamber 29, the force introduced into the metering rod bed 9 does not change. Accordingly, the effective contact pressure between metering rod 7 and the operating surface 3 remains unchanged. Distance fluctuations between the doctoring support bar 17 and operating surface 3 which are caused by uneven wear of metering rod 7, or by unevenness in the operating surface 3, are compensated in the same way. Here too, only a displacement of the piston 45 in the cavity 41 occurs whereby the force that is introduced into the metering rod bed 9 is constant. The piston-cylinder arrangement 37 therefore represents a very simple but highly effective compensation device for compensation of relative distance fluctuations between doctoring support beam 17 and operating surface 3.

With the pressure chamber 29 extending continuously across the entire width of the operating surface 3 in the example illustrated in FIGS. 1 and 2, and with equally sized pistons 45, only a constant force can be exerted at any time. Thus, across the width of operating surface 3, an equal amount of force is exerted against the metering rod bed 9 at every point along metering rod bed 9. This, in turn, means that the effective contact pressure force between the metering rod 7 and the operating surface 3 is uniform at any point. Cross-profiling, in the sense that higher or lower contact pressure may be achieved at individual points across the width of the operating surface 3 by use of pressure variations in pressure chamber 29, is not possible in the example illustrated in FIGS. 1 and 2.

However, because of the large number of pistons 45 in the example illustrated in FIGS. 1 and 2, even strong localized fluctuations of the relative distance between the doctoring support bar 17 and the operating surface 3 can be compensated.

Figure 4:
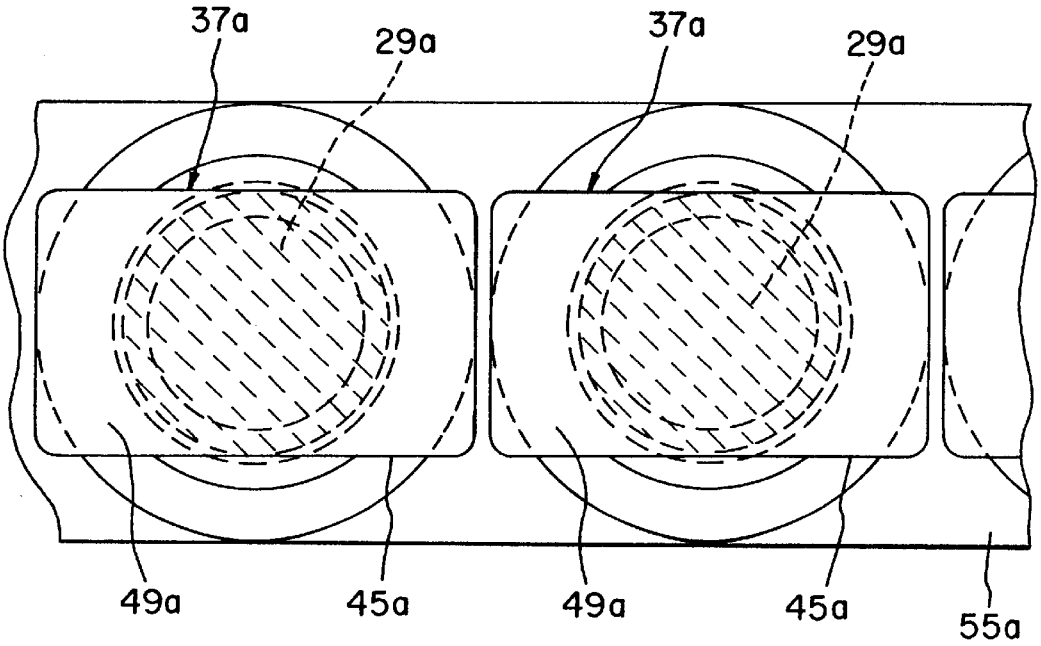
FIG. 4 is a fragmentary, sectional view of the piston arrangement of FIG. 3 taken along line IV—IV.
Figure 3:
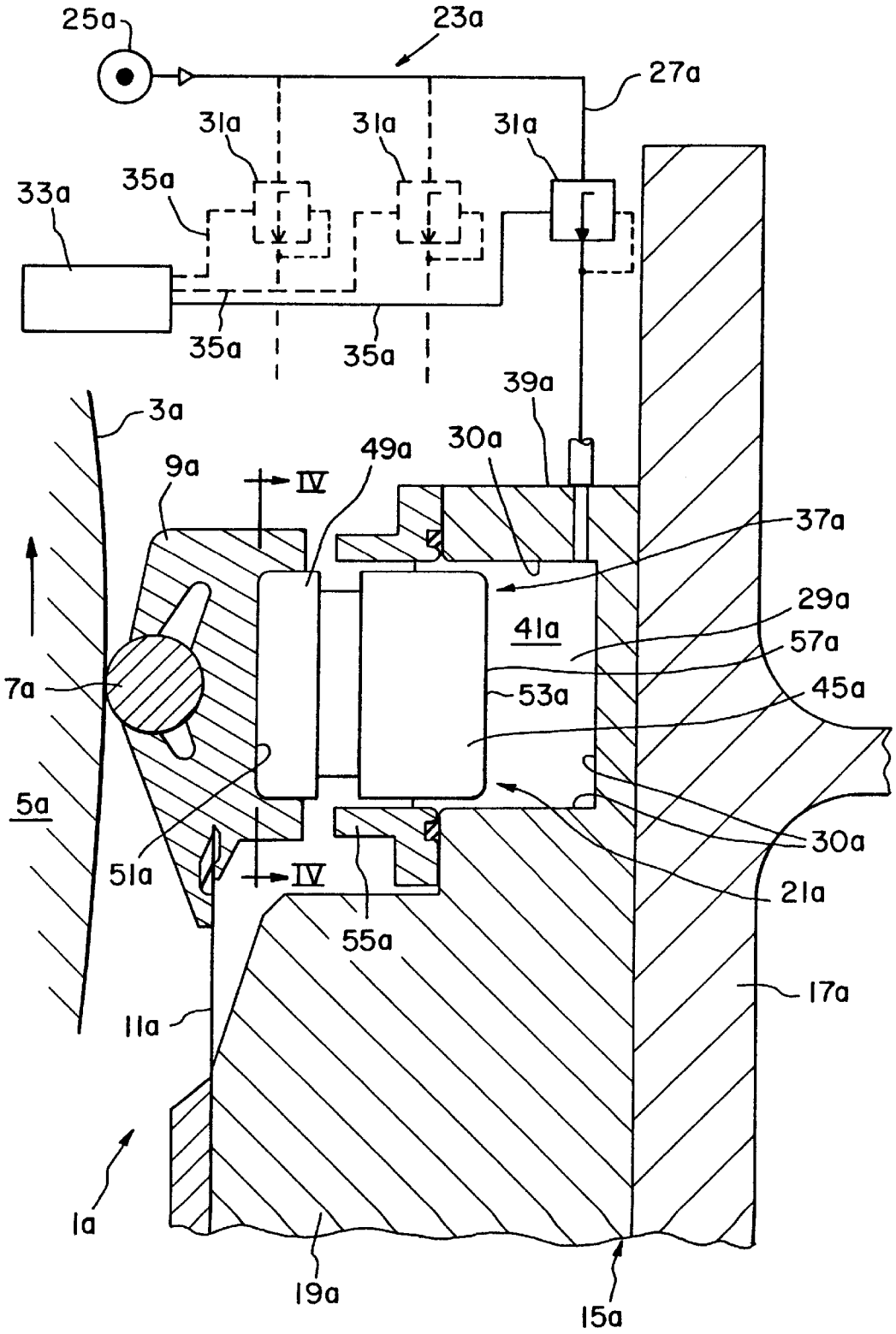
FIG. 3 is a partially schematic, side, sectional view of a second embodiment of a floating doctoring apparatus of the present invention.

Another embodiment is described with the help of FIGS. 3 and 4. For identical components, or components functioning identically as in FIGS. 1 and 2, the same reference numbers will be used, but with the addition of a lower case letter. Since only differences from the structural example illustrated in FIGS. 1 and 2 are to be addressed, repetition of the above descriptions of FIGS. 1 and 2 is avoided.

The embodiment of FIGS. 3 and 4 differs from the embodiment of FIGS. 1 and 2 substantially only in that there is no continuous pressure chamber provided along the width of the operating surface 3*a*, but instead a multitude of individual pressure chambers 29*a* defined by a set of inner walls 30*a*. A piston-cylinder arrangement having one piston 45*a* is allocated to each of these pressure chambers 29*a*. Further, each of these pressure chambers 29*a* is connected to the pneumatic pressure source 25*a* through individual pressure regulating valves 31*a*. This is shown in FIG. 3, where pressure regulating valves 31*a* are shown in broken lines. Each of these pressure regulating valves 31*a* can be triggered independently from each other by the control unit 33*a*, so that a desired pressure, which can be different from the pressures in the other pressure chambers 29*a*, can be adjusted in each of the pressure chambers 29*a*. In this manner, cross profiling of the coating thickness of the medium that is to be applied to the operating surface 3*a* is possible. By appropriate adjustment of the pressures in the pressure chambers 29*a*, locally different contact pressures between metering rod 7*a* and the operating surface 3*a* can be produced along the width of the operating surface 3*a*, which leads to accordingly different local thicknesses of the coating medium.

In the embodiment of FIGS. 3 and 4, the pressure chambers 29*a* are circular, and the pistons 45*a* also possess a correspondingly circular cross section. The piston head 49*a* of each piston 45*a* protruding from the cylinder housing 39*a* is substantially rectangular (FIG. 4), as can also be seen in the embodiment of FIGS. 1 and 2. In the embodiment of FIGS. 1 and 2, the piston head 49 may be integrally formed with its piston 45 because of the elongated rectangular shape of the cavity 41. In contrast, the piston head 49*a* in the embodiment of FIGS. 3 and 4 is, for functional purposes, produced separately from the affiliated piston 45*a*. However, piston head 49*a* is securely connected with piston 45*a* by, for example, being screwed on. As can be seen in FIG. 4, the piston heads 49*a* are located closely together along the width of operating surface 3*a*. Thus, piston heads 49*a* together, with their rectangular shape, ensure a uniform distribution of force. Local peaks of the forces exerted onto the metering rod bed 9 are therefore avoided. This also applies to the embodiment of FIGS. 1 and 2.

In accordance with the cross section of the pressure chambers 29*a* and the pistons 45*a*, the compensation diaphragm 53*a* is also circular. Each pressure chamber 29*a* is covered by its own diaphragm 53*a*.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An apparatus for at least one of scraping and metering a coating medium on a moving operating surface having a width, said apparatus comprising:

a doctoring assembly including a metering rod having a surface extending substantially across the width of the operating surface, said surface of said metering rod being configured for being pressed against the operating surface;

a doctoring support beam supporting said doctoring assembly in a direction transverse to the operating surface, said doctoring support beam being configured for being disposed a predetermined distance from the operating surface, said doctoring support beam having a set of inner walls, said set of inner walls defining a pressurizable chamber, said pressurizable chamber opening toward said doctoring assembly;

a power supply unit configured for exerting a force onto said doctoring assembly to thereby produce a contact pressure between said surface of said metering rod and the operating surface, said force having a flow path, said power supply unit being fluidly coupled with said pressurizable chamber; and a compensation device disposed within said pressurizable chamber in said flow path of said force between said doctoring support beam and said doctoring assembly, said compensation device being configured to compensate for deviations of said predetermined distance between said doctoring support beam and the operating surface to thereby maintain said contact pressure between said surface of said metering rod and the operating surface at a substantially constant level, said compensation device being mechanically coupled with said doctoring assembly.

2. The apparatus of claim 1, wherein said compensation device comprises a pneumatic compensation device.

3. The apparatus of claim 2, wherein said compensation device includes a power assembly having a pressure applying area configured for being activated by a pressure medium to thereby allow said force to be exerted upon said doctoring assembly, said pressure applying area having an effective size substantially independent from said deviations of said predetermined distance between said doctoring support beam and the operating surface, said apparatus further comprising a pressure medium supply arrangement configured for regulating and maintaining said pressure medium at a substantially constant pressure, said substantially constant pressure of said pressure medium being exerted on said pressure applying area of said power assembly.

4. An apparatus for at least one of scraping and metering a coating medium on a moving operating surface having a width, said apparatus comprising:

a doctoring assembly including a metering rod having a surface extending substantially across the width of the operating surface, said surface of said metering rod being configured for being pressed against the operating surface;

a doctoring support beam supporting said doctoring assembly in a direction transverse to the operating surface, said doctoring support beam being configured for being disposed a predetermined distance from the operating surface, said doctoring support beam having a set of inner walls, said set of inner walls defining a pressurizable chamber;

a power supply unit configured for exerting a force onto said doctoring assembly to thereby produce a contact pressure between said surface of said metering rod and the operating surface, said force having a flow path, said power supply unit being fluidly coupled with said pressurizable chamber; and a compensation device disposed in said flow path of said force between said doctoring support beam and said doctoring assembly, said compensation device being configured to compensate for deviations of said predetermined distance between said doctoring support beam and the operating surface to thereby maintain said contact pressure between said surface of said metering rod and the operating surface at a substantially constant level, said compensation device comprising a pneumatic compensation device, said compensation device includes a power assembly having a pressure applying area configured for being activated by a pressure medium to thereby allow said force to be exerted upon said doctoring assembly, said pressure applying area having an effective size substantially independent from said deviations of said predetermined distance between said doctoring support beam and the operating surface said apparatus further comprising a pressure medium supply arrangement configured for regulating and maintaining said pressure medium at a substantially constant pressure, said substantially constant pressure of said pressure medium being exerted on said pressure applying area of said power assembly said power assembly including a piston-cylinder arrangement having a cylinder housing and a piston arrangement, said cylinder housing having a cavity, said piston arrangement having at least one moving piston disposed in said cavity of said cylinder housing, said cavity including a pressure chamber connected to said pressure medium supply arrangement.

5. The apparatus of claim 4, wherein said power assembly includes a compensation diaphragm having an edge, said edge of said compensation diaphragm being secured to said cylinder housing, said compensation diaphragm sealing said pressure chamber of said cavity in a pressure-medium-tight manner, said compensation diaphragm having a first side facing away from said pressure chamber and a second side facing said pressure chamber, said first side of said compensation diaphragm contacting at least one said piston and being configured to transfer force thereto, said pressure applying area of said power assembly comprising said second side of said compensation diaphragm.

6. The apparatus of claim 4, wherein said cylinder housing of said piston-cylinder arrangement is disposed adjacent said doctoring support beam, at least one said piston being coupled with said doctoring assembly such that shifting of said doctoring assembly follows shifting of said at least one piston.

7. The apparatus of claim 6, wherein said at least one piston is separately disengageable from, and is coupled in pressure contact mechanically with said doctoring assembly.

8. The apparatus of claim 6, wherein said at least one piston is substantially unguided at said cylinder housing, said at least one piston being in position-stabilizing positive contact with said doctoring assembly.

9. The apparatus of claim 8, wherein said pressure chamber contains pressure and extends substantially continuously across the width of the operating surface, said compensation diaphragm comprising an elongated strip diaphragm, said elongated strip diaphragm being subjected to said pressure within said pressure chamber substantially across the width of the operating surface, said at least one moving piston comprising a plurality of pistons moving independently from each other, said pistons being distributed along the width of the operating surface, said pistons contacting said compensation diaphragm.

10. The apparatus of claim 8, wherein said pressure chamber comprises a plurality of subchambers disposed along the width of the operating surface, said compensation diaphragm comprising a plurality of substantially circular subdiaphragms, each said subchamber corresponding to a respective said compensation subdiaphragm, said at least one moving piston comprising a plurality of pistons, at least one said piston contacting each said compensation subdiaphragm.

11. The apparatus of claim 10, wherein at least one of said subchambers contains an independently adjustable predetermined pressure.

12. The apparatus of claim 10, wherein each said subchamber contains an independently adjustable predetermined pressure.

13. The apparatus of claim 12, wherein said doctoring assembly includes a metering rod bed carrying a rotating metering rod, said doctoring support beam including an elongated doctoring support bar and a clamp holder, said apparatus further comprising a leaf spring arrangement, said leaf spring arrangement supporting said metering rod bed and interconnecting said metering rod bed and said clamp holder.

14. An apparatus for application of a coating medium onto a moving fiber material web having a width, said apparatus comprising:

a doctoring assembly including a metering rod having a surface extending substantially across the width of the fiber web, said surface of said metering rod being configured for being pressed against the fiber web;

a doctoring support beam supporting said doctoring assembly in a direction transverse to the fiber web, said doctoring support beam being configured for being disposed a predetermined distance from the fiber web, said doctoring support beam having a set of inner walls, said set of inner walls defining a pressurizable chamber, said pressurizable chamber opening toward said doctoring assembly;

a power supply unit configured for exerting a force onto said doctoring assembly to thereby produce a contact pressure between said surface of said metering rod and the fiber web, said force having a flow path said power supply unit being fluidly coupled with said pressurizable chamber; and a compensation device disposed within said pressurizable chamber in said flow path of said force between said doctoring support beam and said doctoring assembly, said compensation device being configured to compensate for deviations of said predetermined distance between said doctoring support beam and the fiber web to thereby maintain said contact pressure between said surface of said metering rod and the fiber web at a substantially constant level, said compensation device being mechanically coupled with said doctoring assembly.

* * * * *

UNITED STATES PATENT AND TRADEMARK OFFICE

CERTIFICATE OF CORRECTION

PATENT NO. : 6,149,726
DATED : November 21, 2000
INVENTOR(S) : Manfred Ueberschär It is certified that error appears in the above-identified patent and that said Letters Patent is hereby corrected as shown below:

Page 1
Under "Foreign Patent Documents" column 2, line 1; delete "43 34 553 A1" and substitute --43 34 556 A1-- therefor Column 2
line 17, delete ":" therefor.

Column 4
Line 50, delete "Ln" and substitute --in-- therefor.

column 10
Line 47, after "surface" insert --,--therefor.
line 53, after "assembly" insert --,-- therefor.

Column 12
Line 27, after "path" insert --,-- therefor.

Signed and Sealed this

Twenty-ninth Day of May, 2001

Nicholas P. Godici

*Attest:*

NICHOLAS P. GODICI

*Attesting Officer*

*Acting Director of the United States Patent and Trademark Office*